US005526670A

United States Patent [19]

Parola

[11] Patent Number: 5,526,670

[45] Date of Patent: Jun. 18, 1996

[54] PROCESS AND DEVICE FOR SHAPING THE END OF A TUBE WITH AN OBLONG CROSS-SECTION TO A CIRCULAR CROSS-SECTION

[75] Inventor: Andrea Parola, Rosta, Italy

[73] Assignee: Borletti Climatizzazione SRL, Italy

[21] Appl. No.: 329,499

[22] Filed: Oct. 26, 1994

[30] Foreign Application Priority Data

Oct. 29, 1993 [IT] Italy ..... TO93A0817

[51] Int. Cl.[6] ..... B21D 41/00

[52] U.S. Cl. ..... 72/416; 72/402; 72/401; 72/367

[58] Field of Search ..... 72/402, 416, 367, 72/394, 403, 411, 412, 401, 400

[56] References Cited

U.S. PATENT DOCUMENTS

| | | | |
|---|---|---|---|
| 2,830,645 | 4/1958 | Huet | 72/367 |
| 3,068,929 | 12/1962 | Rowell | 72/400 |
| 3,780,799 | 12/1973 | Pasternak | 165/150 |
| 4,389,870 | 6/1983 | Boeni | 72/401 |
| 4,930,331 | 6/1990 | Manning | 72/396 |

FOREIGN PATENT DOCUMENTS

| | | | |
|---|---|---|---|
| 0158489 | 10/1985 | European Pat. Off. . | |
| 2474674 | 7/1981 | France . | |
| 347815 | 7/1937 | Italy | 72/416 |
| 427910 | 11/1948 | Italy | 72/403 |
| 1382571 | 3/1988 | U.S.S.R. | 72/402 |

*Primary Examiner*—Daniel C. Crane
*Attorney, Agent, or Firm*—Edward D. Manzo; Ted K. Ringsred

[57] ABSTRACT

A process and device for shaping the end of a tube with an oblong cross-section to a circular cross-section, where the shaping occurs in a single radial compression stage from the exterior. The tube is disposed with its shortest axis in correspondence with two fixed opposite surfaces, having a circular profile with a radius of curvature which is approximately equal to the radius of the circular section of the tube which is to be obtained. A radial compression is then exerted along the longest axis of the oblong section of the non-deformed tube by a pair of shaping surfaces having an angular extension which is complementary to those of the fixed opposite surfaces.

4 Claims, 2 Drawing Sheets

1
2
4
6
8
10
12
16
18
20
24
26
30
F

PROCESS AND DEVICE FOR SHAPING THE END OF A TUBE WITH AN OBLONG CROSS-SECTION TO A CIRCULAR CROSS-SECTION

BACKGROUND OF THE INVENTION

The present invention relates to a process for shaping the end of a tube with an oblong cross-section, in particular with a flat section, to a circular cross-section, in which shaping occurs in a single stage of radial compression from the exterior.

Processes of this type are used in the construction of so-called mechanical assembly-type heat exchangers in which an array of tubes having oblong cross-sections (this term is intended to cover flat, oval, ovoid and similar cross-sections) are fixed to a stack of sheets by radial expansion of the tubes. Subsequently, the ends of the tubes are shaped along a circular cross-section and these ends are inserted in corresponding holes in base plate. The tubes are fixed to the base plate by radial expansion which brings the outer wall of each tube into contact with an elastomeric sealing collar.

The rounding process for the end of a tube having a cross-section which is not circular should produce a deformation which is as regular as possible, since the deformed part should be able to come into contact with the sealing element.

In addition to the uniformity of the section obtained by the plastic deformation, it is necessary for the outer surface of the deformed zone to be completely free of scoring and to be perfectly smooth, in order to avoid micro-losses between the tube and the seal even after the exchanger has been operating for several hours.

The present invention relates specifically to a process in which shaping is performed in a single radial compression stage from the exterior. The conventional method of shaping the tube acting exclusively on its outer surface provides for the use of two jaws with a semi-circular profile which act along the longest axis of the cross-section of the tube. The disadvantage of this process is that there is a risk of producing distinct pinched areas on the exterior of the tube or, at best, scoring which is more or less deep. This occurs since, in the absence of an internal guide in the tube during the deformation process (which can be a punch which perfectly matches its internal diameter once performed), it is very difficult to centre the tube on the device and to force the tube to be deformed in a regular and uniform manner along the entire perimeter of the section.

In fact, it is very easy for one wall of the tube to yield before the other and for it to be outside the theoretical deformation profile whilst the jaws close. With a shaping tool having two jaws, in order to exclude the risk of pinching the tube, it would be necessary to increase the diameter of deformation in such a way that the final result would be a section which is rounded only approximately and this section would be so large that it would force the distance between the tubes to be increased.

Furthermore, in a shaping tool having two jaws, the corners deriving from the intersection of the closure plane of the jaws with the deformation hole represent a scoring risk, since they could cut into the outer surface of the tube which is compressed against them by the deformation effect. In fact, given that the action of an inner punch is not utilized, it is necessary to compress the tube to a greater degree on its outer surface in order to obtain a sufficiently uniform circular section.

SUMMARY OF THE INVENTION

These disadvantages are overcome by the present invention, which preferably includes a process for shaping the end of a tube with an oblong cross-section, in particular a flat section, to a circular cross-section, in which shaping is performed in a single radial compression stage from the exterior, characterized in that:

a pair of fixed opposite surfaces is arranged in correspondence with the shortest axis of the oblong cross-section of the non-deformed tube, the opposite surfaces having a circular profile with a radius of curvature which is substantially equal to the radius of the circular section of the tube which is to be obtained at the end of the shaping process; and a radial compression is exerted along the longest axis of the oblong section of the non-deformed tube by means of a pair of shaping surfaces with a circular profile having a radius of curvature which is equal to those of the opposite surfaces and an angular extension which is complementary to those of the opposite surfaces.

It is also preferred that the travel of the shaping surfaces along the longest axis of the cross-section of the tube is stopped when the shaping surfaces reach a position relative to the opposite surfaces, in which the opposite surfaces and shaping surfaces define an aperture with a circular profile.

The present invention further relates to a device for performing this process, preferably characterized in that it comprises a body which contains the opposite surfaces, which communicate with two guides in which respective slides having the shaping surfaces are slidingly mounted.

It is also preferable that the device is shaped such that, during the deformation process, the cross-section of the tube is always supported and restrained inside a closed deformation zone without the possibility of emerging therefrom and being pinched.

Further characteristics and advantages of the present invention will become clear from the following detailed description, given purely by way of non-limiting example, with reference to the appended drawings.

BRIEF DESCRIPTION OF THE DRAWINGS

In describing the following detailed description, reference is made to the appended drawings, in which.

DETAILED DESCRIPTION OF THE PREFERRED EMBODIMENT

Figures 1, 2, 3:
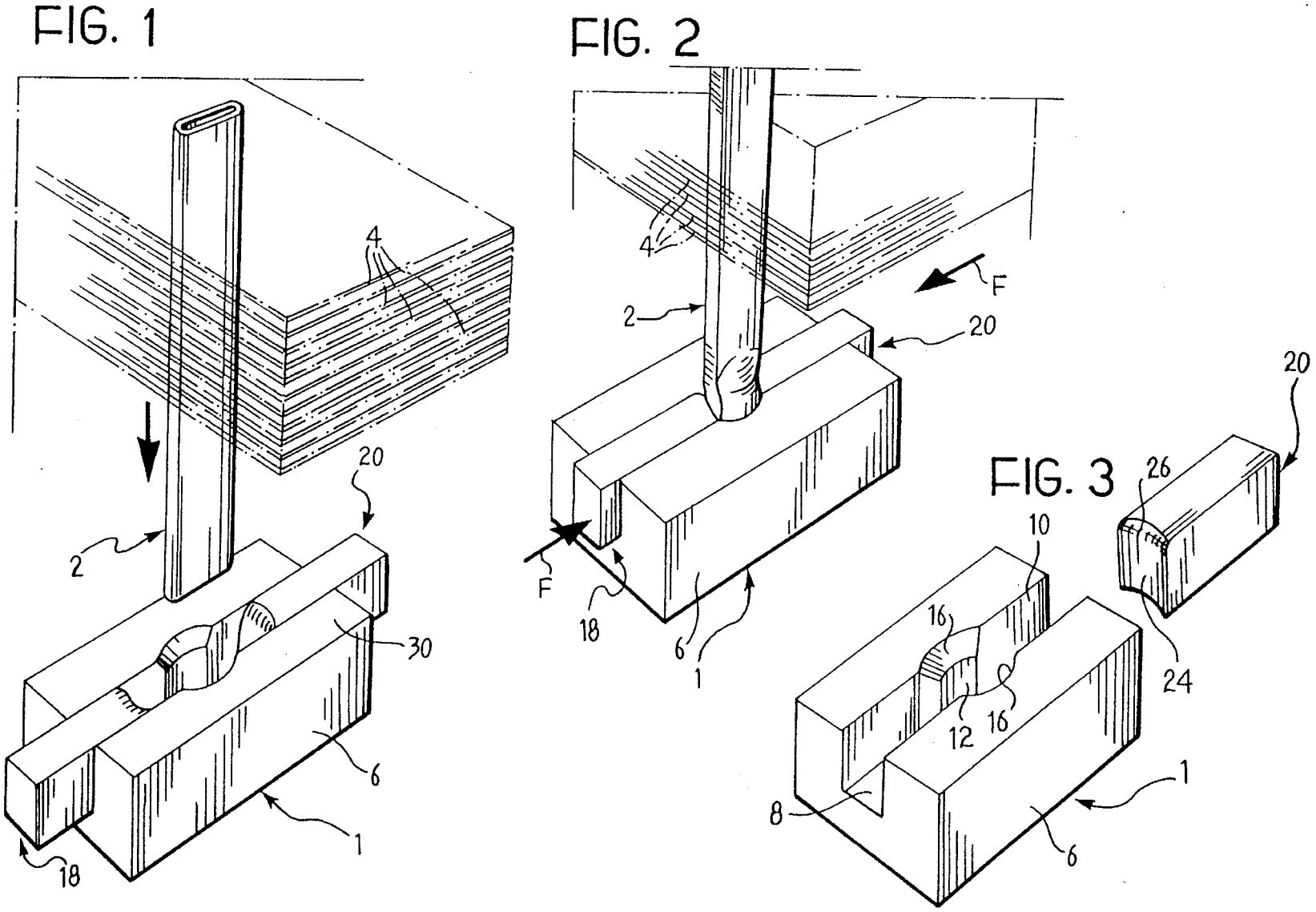
FIGS.1 and 2 are schematic perspective views illustrating two stages of the process according to the invention.
FIG.3 is a schematic and partial perspective view of a shaping device used in the process according to the invention.

With reference to the drawings, a tool for shaping the end of a tube 2 having an oblong cross-section, in the specific case illustrated in the drawings, having a flat section, to a circular cross-section is indicated 1. The tube 2, together with a plurality of other identical tubes not shown in the drawings, is fixed by mechanical expansion to a stack of sheets 4, according to known technology, so as to form the heat exchanger network of a finned heat-exchanger which is used in engine cooling systems or in a motor vehicle air conditioning system.

The shaping tool 1 comprises a body 6 having two guides 8, 10 consisting of a straight groove with a U-shaped profile. The two guides 8, 10 communicate with a pair of opposite surfaces 12, 14 having a circular profile with a radius R (see FIG.4). The opposite surfaces 12, 14 are filleted at one of their ends to flared surfaces with a conical or radial development 16 (FIG.3).

Slidingly mounted in the guides 8, 10 of the body 6 is a pair of slides 18, 20 provided with respective shaping surfaces 22, 24 having a circular profile with a radius R and an angular extension which is complementary to those of the opposite surfaces 12, 14. The shaping surfaces 22, 24 of the slides 18, 20 are also filleted at one of their ends to flared or radial conical surfaces 26 having a profile which is complementary to that of the flared surfaces 16 of the body 6 (see FIG.3).

Figure 4:
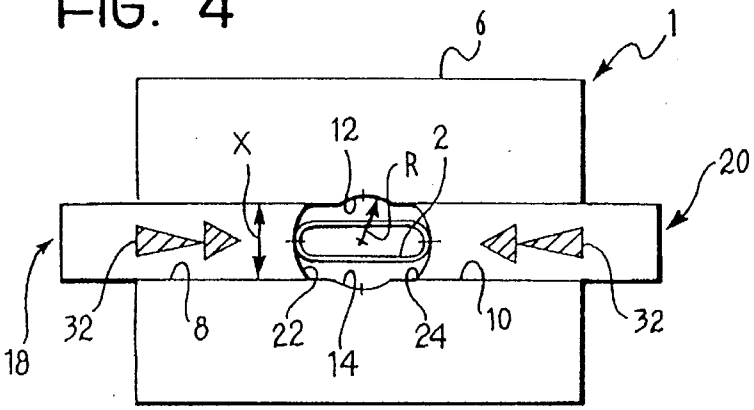
FIGS.4 and 5 are schematic views illustrating the shaping stage.

With reference to FIG.4, the shortest axis of the cross-section of the non-deformed tube is in correspondence with the opposite surfaces 12, 14, whilst the longest axis is aligned with the sliding direction of the slides 18, 20. When the tube has been inserted, the slides 18, 20 are made to slide towards one another, applying forces F by actuator devices of any known type.

Figure 6:
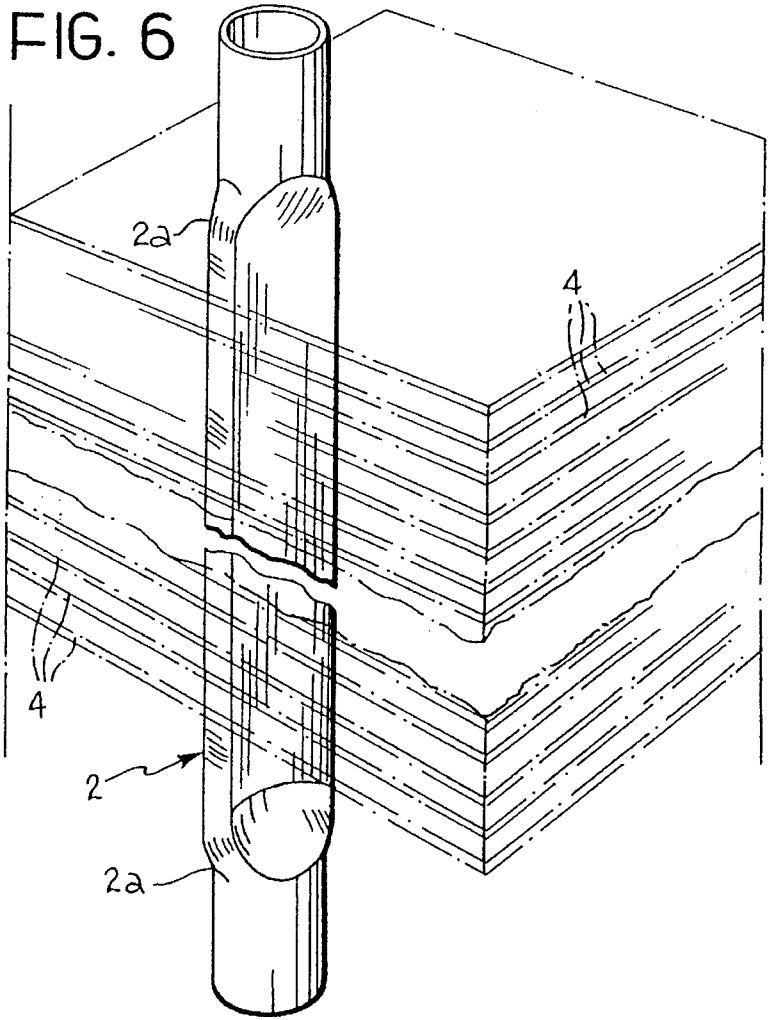
FIG.6 is a perspective view illustrating a tube at the end of the shaping process.
Figure 5:
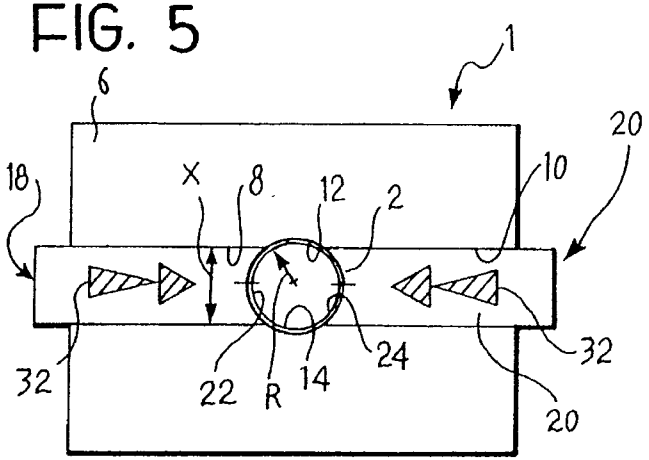

As is shown in FIGS.4 and 5, the shaping surfaces 22, 24 of the slides 18, 20 act in the direction of the longest axis of the tube 2 and cause a deformation of the cross-section of the tube which, starting from the shortest radii, affects the entire cross-section which is forced to assume a circular profile with a radius R at the end of the closing of the slides 18, 20 (FIG.5). The flared surfaces 16, 26 of the body 6 and of the slides 18, 20 determine a connection zone 2*a* on the tube (FIG.6). The travel of the slides 18, 20 is stopped when the shaping surfaces 22, 24 reach a position in which they define an aperture with a circular profile together with the opposite surfaces 12, 14.

During the change of shape, the cross-section of the tube 2 is always supported and restrained inside a closed deformation zone without the possibility of emerging therefrom and being pinched. The contact of the tube walls with the end corners of the opposite surfaces 12, 14 and shaping surfaces 22, 24 occurs only when these corners are perfectly coupled without any risk of the surface of the tube being scored.

In order to alter the quality of deformation, it is sufficient to vary the ratio between the diameter of the deformed tube and the thickness X of the slides 18, 20.

What is claimed is:

1. A process for shaping the end of a tube with an oblong cross-section, having a shortest axis and a longest axis, to a circular cross-section, in which shaping is performed in a single radial compression stage from the exterior, comprising the steps of:

arranging a pair of unmovingly fixed opposite surfaces in correspondence with the shortest axis of the oblong cross-section of the tube, the opposite surfaces having a circular profile with a radius of curvature which is substantially equal to the radius of the circular section of the tube which is to be obtained at the end of the shaping process; and exerting a radial compression along the longest axis of the oblong section of the tube by means of a pair of shaping surfaces with a circular profile having a radius of curvature which is equal to the radius of curvature of said opposite surfaces and an angular extension which is complementary to those of the opposite surfaces.

2. The process according to claim 1, wherein the travel of the shaping surfaces along the longest axis of the tube is stopped when the shaping surfaces reach a position relative to the opposite surfaces, in which the opposite surfaces and shaping surfaces define an aperture with a circular profile.

3. A device for shaping the end of an oblong tube, with a cross-section having a shortest axis and longest axis, into a circular cross-section having a desired radius of curvature, in which shaping can be performed in a single radial compression stage from the exterior of the tube, said device comprising:

a pair of unmovingly fixed opposite surfaces that can be positioned in correspondence with the shortest axis of the oblong tube, said opposite surfaces having a circular profile with a radius of curvature which is substantially equal to the desired radius of curvature of the circular cross-section which is to be obtained after shaping; and a pair of shaping surfaces that can be positioned along the longest axis of the oblong tube, said shaping surfaces having a circular profile with a radius of curvature which is substantially equal to the radius of curvature of said opposite surfaces, and having an angular extension which is complementary to that of said opposite surfaces, said shaping surfaces being slidingly mounted in a pair of guides which communicate with said opposite surfaces, so as to allow for travel of said shaping surfaces along the longest axis of the oblong tube.

4. The device of claim 3, wherein the opposite surfaces and shaping surfaces are shaped and positioned so that, when an oblong tube is deformed into a circular tube by travel of the shaping surfaces along the longest axis of the oblong tube, the cross-section of the tube is always supported and restrained inside a closed deformation zone without the possibility of emerging therefrom and being pinched.

* * * * *